US005806739A

United States Patent [19]

Wood

[11] Patent Number: 5,806,739

[45] Date of Patent: Sep. 15, 1998

[54] CONCEALED WEAPON HOLDER

[75] Inventor: Lonnie Wood, Vero Beach, Fla.

[73] Assignee: M.C.Q., Inc., North Miami Beach, Fla.

[21] Appl. No.: 924,524

[22] Filed: Sep. 5, 1997

Related U.S. Application Data

[63] Continuation-in-part of Ser. No. 808,732, Feb. 28, 1997.

[51] Int. Cl.[6] ..... A47F 7/00

[52] U.S. Cl. ..... 224/555; 224/255; 224/557; 224/567; 224/901; 224/901.2; 224/912; 211/64; 248/309.2

[58] Field of Search ..... 224/912, 255, 224/243, 567, 557, 901, 901.2, 901.8; 248/309.2, 309.1; 211/64; 206/317; 42/90, 106, 70.11, 70.06, 70.07, 70.01

[56] References Cited

U.S. PATENT DOCUMENTS

| | | | |
|---|---|---|---|
| 2,765,107 | 10/1956 | Browning | 224/255 |
| 3,468,427 | 9/1969 | Leslie | 211/64 |
| 4,260,087 | 4/1981 | Leaver | 224/912 |
| 5,188,328 | 2/1993 | Thompson | 224/912 |
| 5,579,923 | 12/1996 | Hemmerlein | 211/64 |

*Primary Examiner*—Linda J. Sholl

*Attorney, Agent, or Firm*—J. Sanchelima

[57] ABSTRACT

A holder for weapons that include a barrel with a through opening and a trigger guard. A main late assembly has a perpendicularly extending fixed base portion at one end and a movable base portion slidably mounted thereon to accommodate barrels of different dimensions. A pin receivable within the through opening is rigidly and perpendicularly mounted on the movable base portion. A pivotally mounted trigger guide assembly partially houses the trigger guard and, with the pin, supports the weapon when the holder is mounted to a flat surface.

11 Claims, 1 Drawing Sheet

CONCEALED WEAPON HOLDER

OTHER RELATED APPLICATIONS

The present application is a continuation-in-part of U.S. patent application Ser. No. 08/808,732, filed on Feb. 28, 1997, pending, which is hereby incorporated by reference.

BACKGROUND OF THE INVENTION

1. Field of the Invention

The present invention relates to a concealed weapon holder and more particularly, to the type that is mounted to a flat surface.

2. Description of the Related Art

Applicant believes that the closest reference corresponds to applicant's own patent application. The present application, however, includes subject matter not disclosed in the parent application, particularly, since the holder is mounted on a flat surface.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a concealed weapon holder that can be readily mounted on a flat surface, such as the underside of a table top.

It is another object of this invention to provide a concealed weapon holder that makes the weapon readily available to a user.

It is yet another object of this invention to provide such a concealed weapon holder that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 3:
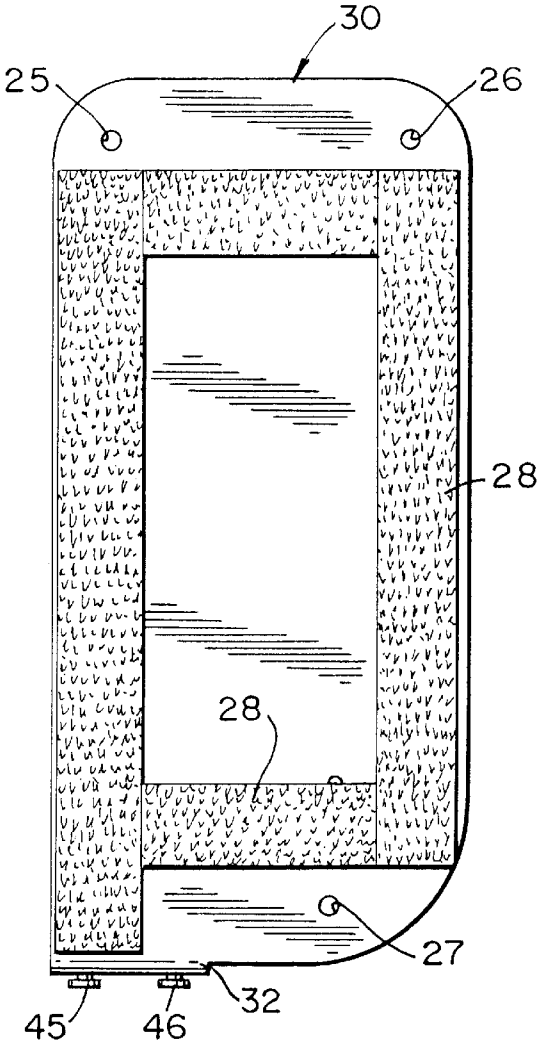
FIG. 3 is a bottom view of this invention.
Figure 2:
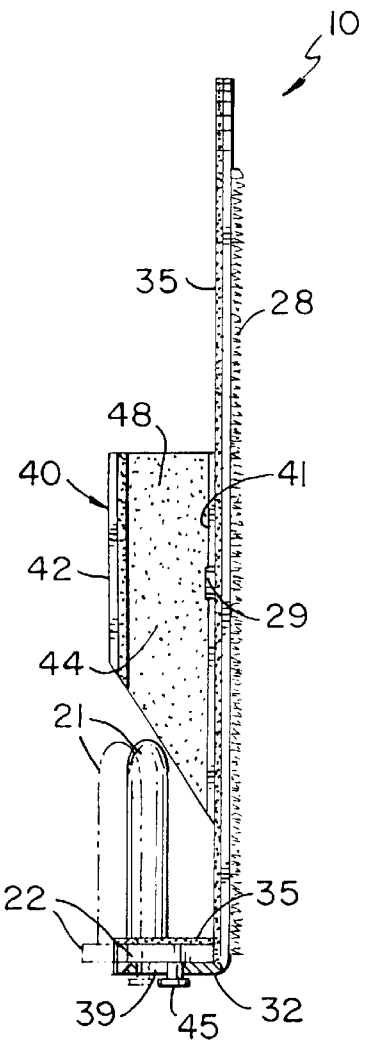
FIG. 2 is an elevational side view of this invention, showing displacement of a pistol barrel supporting assembly in phantom, and a partial cross section showing a slot for a headed pin.
Figure 1:
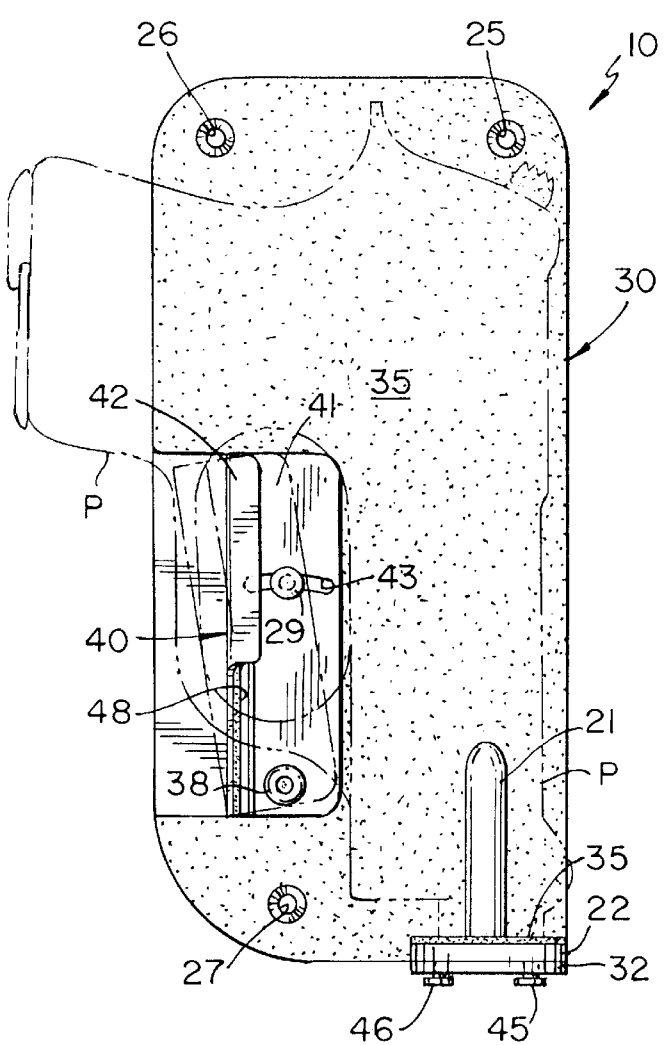
FIG. 1 is a top view of the present invention showing the guiding plate assembly in phantom for a different position.

The invention described and claimed herein and referenced with numeral 10 includes a plate assembly 30, with a substantially rectangular shape, and fixed base portion 32 mounted perpendicularly at one edge of assembly 30, and guiding plate assembly 40 pivotally mounted to main plate assembly 30. Movable base portion 22, however, is slidably mounted on fixed base portion 32 so that pin 21 is kept at a parallel and spaced apart separation with respect to the surface of assembly 30. Headed pins 45 and 46 are perpendicularly mounted to the underside of base portion 22 and passed through slots 39 and 39' (not shown), respectively, in fixed base portion 32. As best seen in FIG. 2, this feature permits a user to adjust holder 10 to the particular thickness of the barrel of pistol P. Cloth or equivalent soft material 35 is mounted over the upper side of base portion 22 and main plate 30 to prevent any damage to the barrel and to make the engagement noise-less.

Guiding plate assembly 40 has plate member 41 pivotally mounted to main plate assembly 30. Assembly 40 includes spacer wall 44, mounted perpendicularly on plate member 41, and guiding wall 42, which is in turn perpendicularly mounted to spacer wall 44, preferably at the edge. Headed pin 29 is rigidly mounted to main assembly 30, spaced apart from pivoting point 38. Headed pin 29 is cooperatively positioned through slot 43. The underside of the head portion of headed pin 29 comes in relatively tight contact with the upper side of plate member 41 so that when a user moves assembly 40, spacer wall 44 comes in contact with the trigger guard of pistol P. In this manner, guiding wall 42 can be adjustably brought next to the trigger guard so that wall 42 can help support pistol P along with pin 21. Spacer wall 44 is also covered with clothing or other soft materials 48.

In addition, plate assembly 30 includes openings 25; 26 and 27. Openings 25; 26 and 27 are designed to cooperatively receive any fastening members through. Alternatively, or in addition to fastening members, pressure sensitive adhesive means or male and female hook and loop mating members, such as Velcro pads, 28 can be used to secure holder 10 to a flat surface. The flat surface can be a horizontal, vertical or in between. A typical application for the present invention would be the underside of a counter top.

The weapon is then supported by pin 21, which is receivable within the through opening of the weapon, and guiding plate assembly 40 that houses the weapon's trigger guard.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A holder for a weapon having a barrel with a through opening and a trigger guard, and said holder to be mounted on a flat surface, comprising:

A) a main plate assembly having first and second sides, and including fastening means for affixing said first side to said flat surface, said main plate assembly having a substantially rectangular projected shape with two ends;

B) a fixed base portion perpendicularly mounted to one of said ends;

C) a movable base portion having an upper side and being slidably mounted over said fixed base portion and further including a pin member rigidly and perpendicularly mounted thereon and said pin member being receivable within said through opening; and D) a trigger guide assembly having a first plate member pivotally mounted to said main plate assembly, and said first plate member having a spacer plate having an inner side and said spacer plate being perpendicularly mounted to said first plate and a guiding plate member perpendicularly mounted to said spacer plate so that said trigger guard is receivable within said guiding plate and said first plate.

2. The holder set forth in claim 1 wherein said first plate is snugly pivotally mounted to said main plate assembly so that said first plate stays in place unless moved by a predetermined amount of force.

3. The holder set forth in claim 2 wherein said first plate includes a first slot at a spaced apart portion with respect to the pivoting point of said first plate and said main plate assembly includes a perpendicularly mounted headed pin in snugly guiding combination with said first slot.

4. The holder set forth in claim 3 wherein said fixed base portion includes a second slot perpendicularly extending from said main plate assembly and said movable base portion including a second headed pin in guiding cooperation combination with said second slot.

5. The holder set forth in claim 4 wherein said fixed base portion includes a third slot perpendicularly extending from said main plate assembly and at a parallel and spaced apart relationship with respect to said second slot, and said movable base portion including a third headed pin in guiding cooperation combination with said third slot.

6. The holder set forth in claim 5 wherein said upper side is covered with soft material.

7. The holder set forth in claim 5 wherein said first side is covered with a soft material.

8. The holder set forth in claim 5 wherein said inner side is covered with a soft material.

9. The holder set forth in claim 5 wherein said fastening means includes removable pressure sensitive male and female loop and hook members for removably mounting said holder to said flat surface.

10. The holder set forth in claim 5 wherein said fastening means includes at least one screw member.

11. The holder set forth in claim 5 wherein said fastening means includes pressure sensitive adhesive means.

* * * * *